US010774995B2

(12) United States Patent
Shim

(10) Patent No.: US 10,774,995 B2
(45) Date of Patent: Sep. 15, 2020

(54) PCB MODULE LED LAMP HAVING IRRADIATION ANGLE SETTING UP FUNCTION FOR EDISON SOCKET

(71) Applicant: Young Chel Shim, Hwaseong-si (KR)

(72) Inventor: Young Chel Shim, Hwaseong-si (KR)

( * ) Notice: Subject to any disclaimer, the term of this patent is extended or adjusted under 35 U.S.C. 154(b) by 16 days.

(21) Appl. No.: 16/594,100

(22) Filed: Oct. 7, 2019

(65) Prior Publication Data

US 2020/0224829 A1 Jul. 16, 2020

(30) Foreign Application Priority Data

Jan. 10, 2019 (KR) ..... 10-2019-0003559

(51) Int. Cl.

| | |
|---|---|
| ***F21K 9/235*** | (2016.01) |
| ***F21K 9/237*** | (2016.01) |
| ***F21V 21/14*** | (2006.01) |
| ***F21K 9/66*** | (2016.01) |
| *F21Y 105/16* | (2016.01) |
| *F21Y 115/10* | (2016.01) |
| *F21Y 107/30* | (2016.01) |
| *F21V 14/02* | (2006.01) |
| *F21V 21/30* | (2006.01) |

(52) U.S. Cl.

CPC ..... *F21K 9/235* (2016.08); *F21K 9/237* (2016.08); *F21K 9/66* (2016.08); *F21V 21/14* (2013.01); *F21V 14/02* (2013.01); *F21V 21/30* (2013.01); *F21Y 2105/16* (2016.08); *F21Y 2107/30* (2016.08); *F21Y 2115/10* (2016.08)

(58) Field of Classification Search

CPC . F21K 9/235; F21K 9/237; F21K 9/66; H01R 33/22; H01R 33/46

See application file for complete search history.

(56) References Cited

U.S. PATENT DOCUMENTS 2,231,565 A * 2/1941 De Reamer ..... H01R 33/94 439/8
4,333,132 A * 6/1982 Paley ..... F21V 21/29 362/389

(Continued)

FOREIGN PATENT DOCUMENTS

JP 6090267 3/2017
KR 10-132509 10/2013

(Continued)

*Primary Examiner* — Zheng Song

(74) *Attorney, Agent, or Firm* — Jake K. Lee

(57) ABSTRACT

The present disclosure discloses a plate-shaped LED lamp fixture with an irradiation angle setting function for an Edison socket, including a threaded portion and a terminal on the periphery and the lower end of a base coupled to the Edison socket, a screw portion formed on an upper end of the base, a sphere body formed above the screw portion, a concave inlet portion in close contact with the sphere body above the screw portion, an engagement member configured by installing a connection plate above, a cover which covers the outside of the concave inlet portion of the engagement member and formed integrally with a tightening nut fastened to the screw portion of the base, and first position fixing means and second position fixing means fixed to the connection plate above the engagement member and fix the plate-shaped LED, and the plate-shaped LED is fixed at a required angle.

2 Claims, 23 Drawing Sheets

(56) References Cited

U.S. PATENT DOCUMENTS

| | | | | |
|---|---|---|---|---|
| 6,100,803 | A * | 8/2000 | Chang | F21V 21/30 250/221 |
| 6,113,433 | A * | 9/2000 | Al-Turki | H01R 33/94 362/228 |
| 6,527,466 | B1 * | 3/2003 | Blier | F16M 11/12 362/418 |
| 2011/0021081 | A1 * | 1/2011 | Lin | H01R 33/94 439/641 |
| 2014/0098548 | A1 * | 4/2014 | Huang | F21V 21/30 362/362 |
| 2014/0099801 | A1 * | 4/2014 | Liao | H01R 13/6205 439/39 |
| 2015/0131285 | A1 * | 5/2015 | Lee | F21S 8/036 362/249.11 |
| 2015/0132974 | A1 * | 5/2015 | Kapella | H01R 33/92 439/8 |
| 2015/0377457 | A1 * | 12/2015 | Barry | F21V 19/02 362/426 |

FOREIGN PATENT DOCUMENTS

| | | |
|---|---|---|
| KR | 10-1612865 | 4/2016 |
| KR | 10-1709728 | 2/2017 |
| KR | 10-2018-0114476 | 10/2018 |
| KR | 20-2008-0005178 | 11/2018 |

* cited by examiner

PCB MODULE LED LAMP HAVING IRRADIATION ANGLE SETTING UP FUNCTION FOR EDISON SOCKET

CROSS-REFERENCE TO RELATED APPLICATION

This patent application claims priority under 35 U.S.C. § 119 to Korean Patent Application No. 10-2019-0003559 filed on Jan. 10, 2019, the entire contents of which are incorporated by reference herein.

TECHNICAL FIELD

The present disclosure relates to a plate-shaped LED lamp fixture with an irradiation angle setting function for an Edison socket that is used as a security lamp or a street lamp installed on a road for a pedestrian.

BACKGROUND

A structure of a general security lamp of related art may be seen in Korean Utility Model No. 20-2008-0005178 (Title: Electric lamp for street lighting fixture; referred to as "cited invention 1"), which is illustrated in FIG. 1.

As disclosed therein, in the related art, a metal halide lamp is coupled to the Edison socket by rotating a base thereof, and if the metal halide lamp is required to replace, the base is rotated in the opposite direction to be removed and replaced with a new lamp. To this end, a diameter of the metal halide lamp has to be less than a distance D between the center of the Edison socket and a reflector, as illustrated in FIG. 1. However, a security lamp or a street lamp using an LED has recently been used widely, which is configured by assembling a large number of LEDs on a PCB. Specifically, the large number of LEDs are dispersed and arranged on the PCB, which gives rise to the increase in the width thereof.

Accordingly, a width of the plate-shaped LED is several times greater than the distance D, and thereby, the plate-shaped LED may not be mounted in the Edison socket. Thus, the Edison socket that is mounted in the existing luminaire can't be used, and thus, a problem occurs in which there is a construction work and an economic burden for replacing the luminaire itself.

In order to solve such a problem, an LED lamp has been manufactured in a narrow and long shape similar to an appearance of a metal halide lamp such that a socket and a housing of a security lamp or a street lamp may be used as it is, and an example thereof is illustrated in FIGS. 3 and 4 of Korean Patent No. 10-1709728 (Title of Invention: LED lighting apparatus; referred to as "cited invention 2") and Korean Patent Publication No. 10-2018-0114476 (Title of Invention: LED lighting apparatus; referred to as "cited invention 3").

In the cited inventions 2 and 3, a printed circuit board is formed to have a hollow pillar structure, and an LED chip is disposed on the printed circuit board, and the printed circuit board is put in the same cover member as a metal halide lamp to allow power to be supplied thereto, and thereby, a radius of the LED lighting device may be less than or equal to the distance D between the center of the Edison socket and the reflector. Since the existing metal halide lamp may be inserted into a socket of a housing to be used, the cited inventions 2 and 3 have an advantage that may solve an economic burden of replacing the LED lamp and the whole housing and Hassle due to a replacement construction work. Meanwhile, the cited inventions 2 and 3 have a problem in which since a space to emit heat generated during the LED lighting process is hard to secure, a failure rate is high due to a thermal damage of an LED in summer or the like. Further, since the LED has to be installed on a pillar of a limited area having a diameter smaller than the bulb of the metal halide lamp, the number of installable LEDs is limited, resulting in insufficient light quantity. In addition, the cited Invention 2 and 3 have a problem in which since the LED is installed around the hollow pillar, the LED emits light in all directions, and since the LED light has a high straightness, a light emission efficiency is reduced in the process of collecting light in a down direction which is a direction necessary for a security lamp or a street lamp.

SUMMARY

In order to solve these problems, provided is a plate-shaped LED lamp fixture capable of setting an irradiation angle for an Edison socket such that a wide plate-shaped LED may be used while still using the Edison socket.

Another object of the present disclosure is to provide a plate-shaped LED lamp fixture with an irradiation angle setting function for an Edison socket in which a plate-shaped LED is divided into two or more such that angles thereof may be adjusted and an irradiation angle of light may be adjusted.

In order to achieve the above-described objects, the present disclosure provides a plate-shaped LED lamp fixture with an irradiation angle setting function for an Edison socket including a base coupled to the Edison socket; a screw portion formed at an upper end of the base; a sphere body formed above the screw portion; an engagement member configured with a concave inlet portion in close contact with the sphere body, and a connection plate fixed to the concave inlet portion; a cover in which a pressing portion covering an outside of the concave inlet portion of the engagement member, a through-hole passing through the connection plate, and a tightening nut fastened to the screw portion of the base 100 are formed; a plate which is fixed to the connection plate of the engagement member and includes a center hole connected to a rotation axis of the plate-shaped LED and first position fixing means for fixing an angle of the plate-shaped LED; a rotation plate in which an axis hole is formed on the same axis as a center hole of the plate and includes second position fixing means fastened to the first position fixing means; and the plate-shaped LED 500 which is fixed to the rotation plate and whose rotation axis is installed coaxially with the center hole of the plate to integrally rotate with a rotation plate around the rotation axis. A plurality of the plate-shaped LEDs and a plurality of the rotation plates are provided in the plate.

According to the present disclosure, a plate-shaped LED lamp may be used by using a luminaire provided with an existing Edison socket as it is, an existing metal halide lamp is replaced with the plate-shaped LED lamp while minimizing a cost associated with purchase and replacement of the luminaire, and thereby, a high brightness may be obtained along with power saving.

In addition to this, since the present disclosure may use a plate-shaped LED having a plate width as wide as necessary by using an Edison socket, it is possible to not only solve a problem of heat dissipation occurring when LEDs are densely arranged in a pillar having a narrow diameter in the same manner as in cited inventions 2 and 3 and but also install the sufficient number of LEDs as needed. Also, since the light may be emitted in a desirable direction by first and second position fixing means, there is a useful effect that efficient lighting is optimized on the spot.

DETAILED DESCRIPTION OF THE DISCLOSURE

Embodiments of the present disclosure will be described in detail as follows with reference to the accompanying drawings such that those skilled in the art may easily implement the present disclosure.

Figure 1:
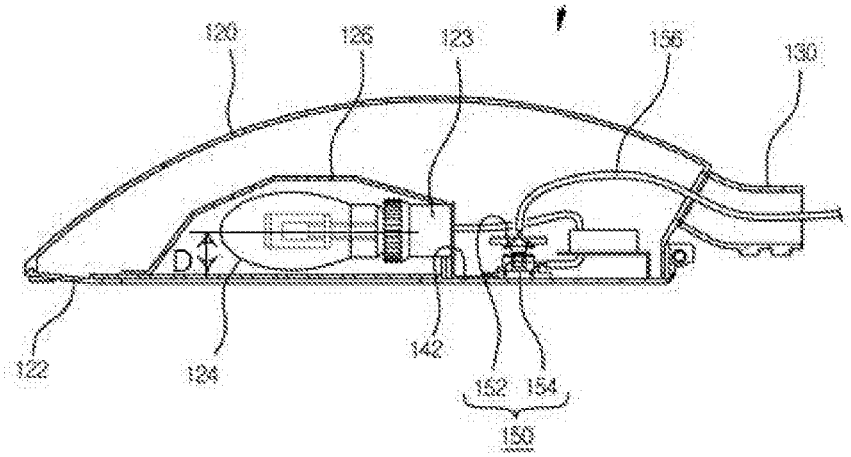
FIG. 1 is a longitudinal sectional view illustrating a structure of a luminaire using an Edison socket of a related art.
Figure 2:
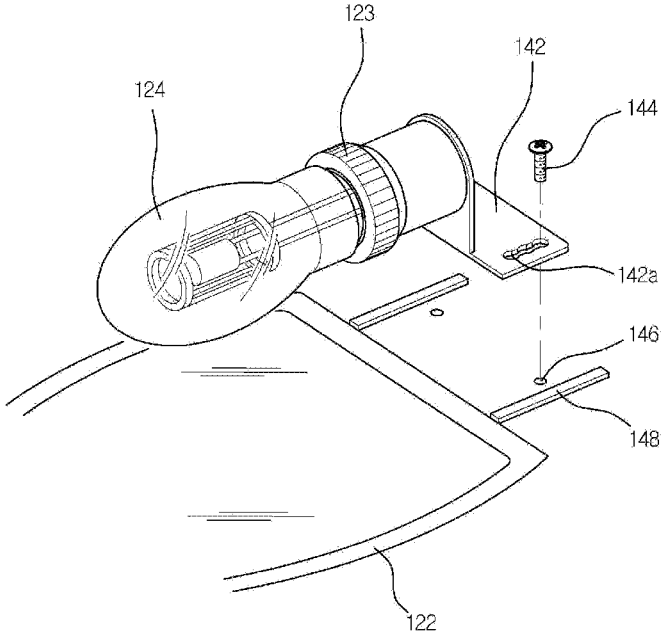
FIG. 2 is a perspective view of the luminaire using the Edison socket illustrated in FIG. 1.
Figure 3:
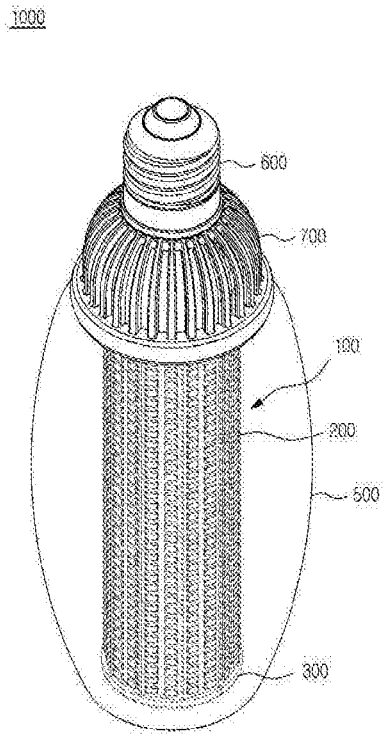
FIGS. 3 and 4 are perspective views illustrating an LED lamp using the Edison socket of the related art.
Figure 4:
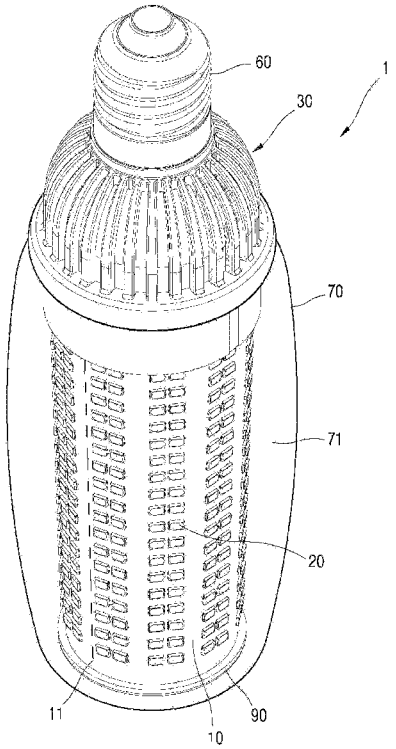
Figure 5:
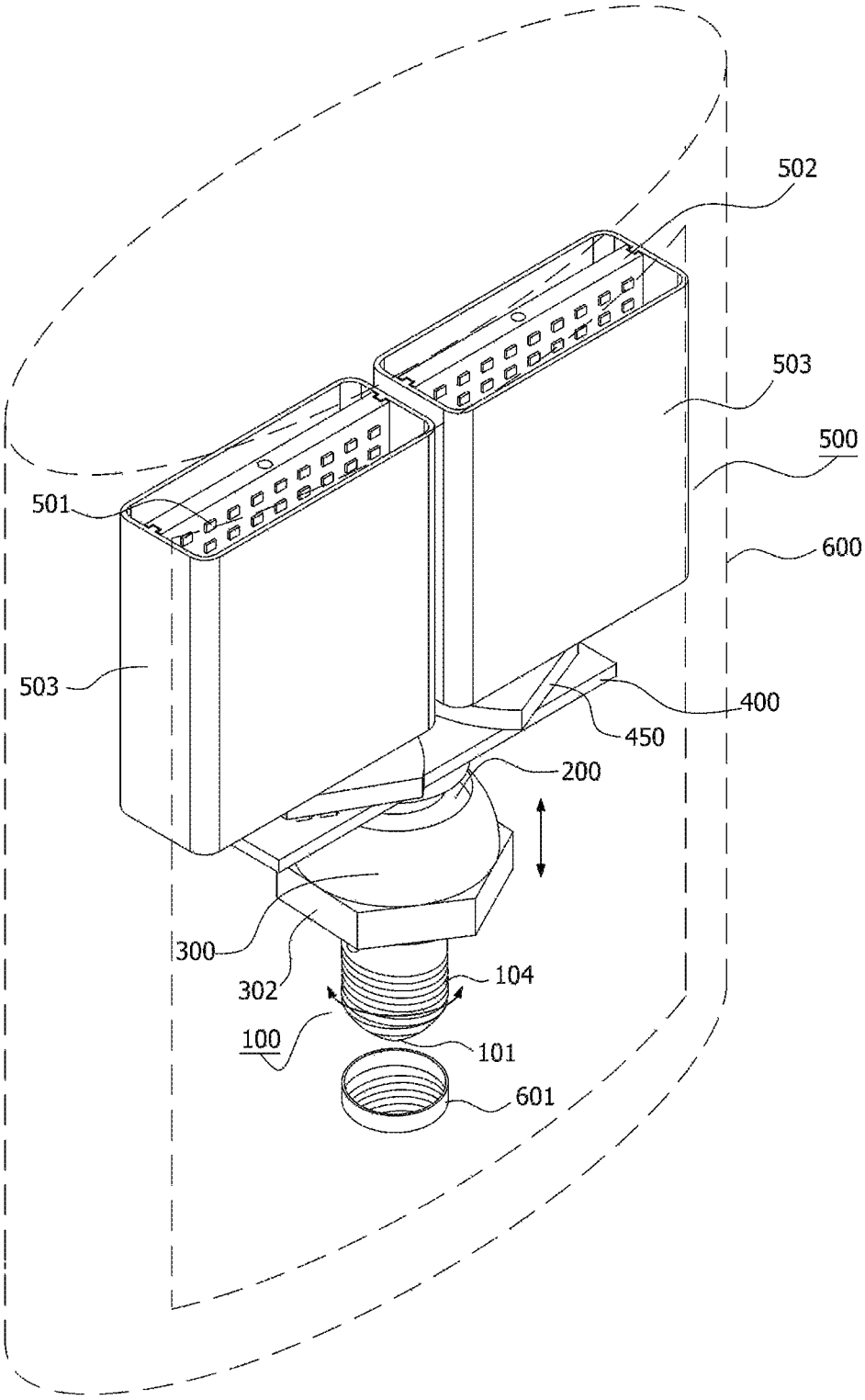
FIG. 5 is a perspective view illustrating a plate-shaped LED lamp fixture for the Edison socket according to the present disclosure.

An overall configuration of a specific embodiment according to the present disclosure is illustrated in FIG. 5. As can be seen in FIG. 5, the present disclosure includes an Edison socket 601 and a plate-shaped LED 500 in which an LED 501 is mounted on a wide PCB 502 of a known thin lamp fixture casing 600.

Figure 6:
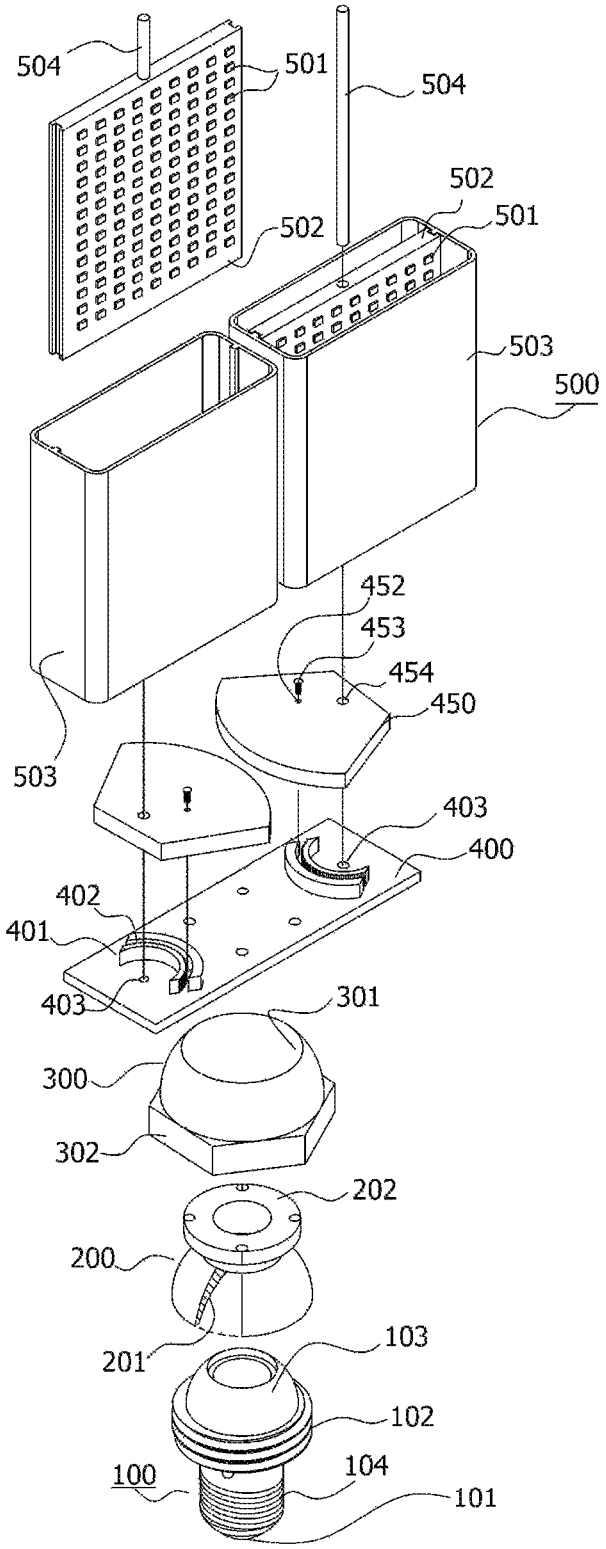
FIG. 6 is an exploded perspective view of FIG. 5 according to the present disclosure.
Figure 7:
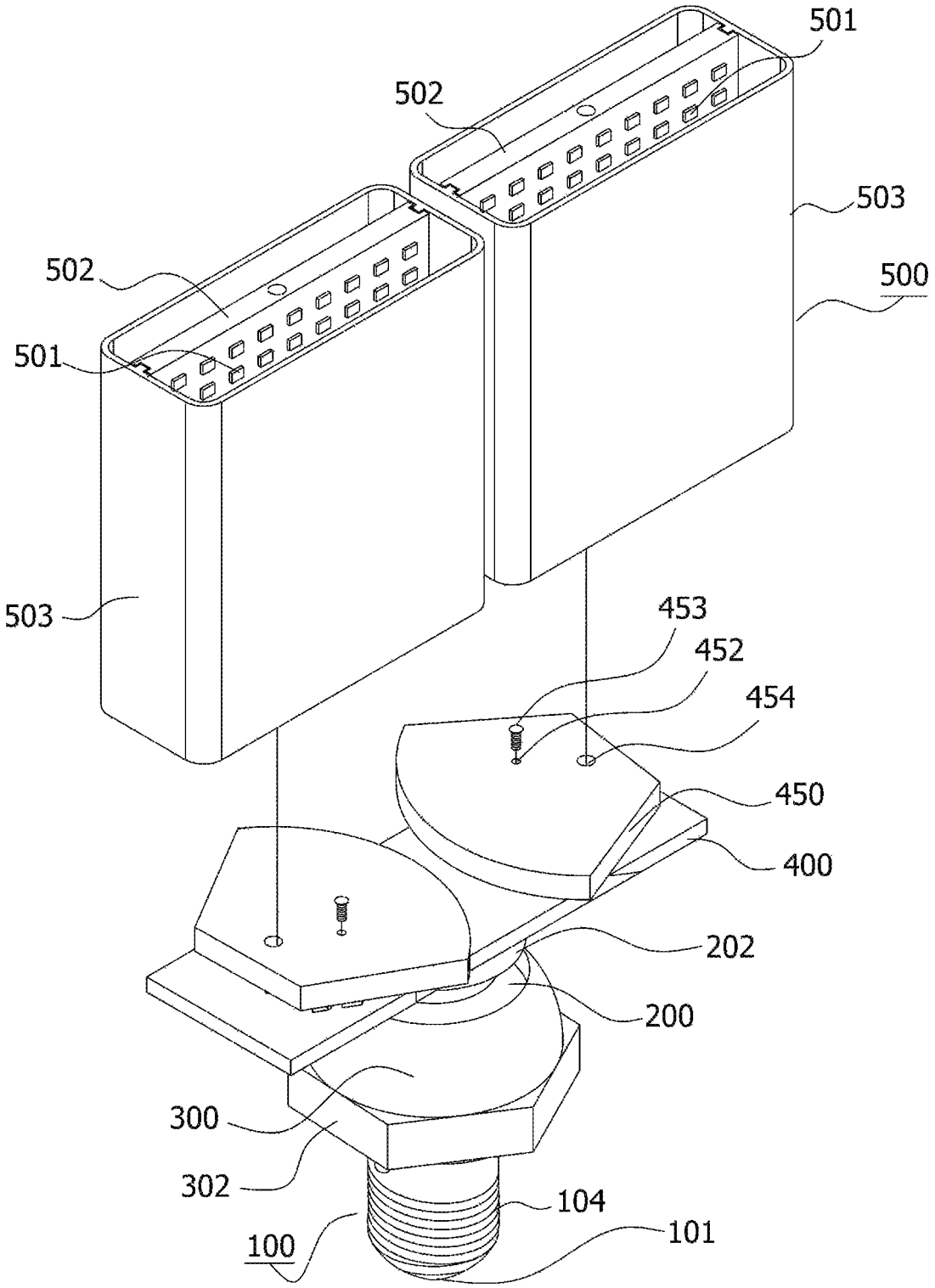
FIG. 7 is a perspective view illustrating an irradiation angle setting structure of the fixture according to the present disclosure.
Figure 8:
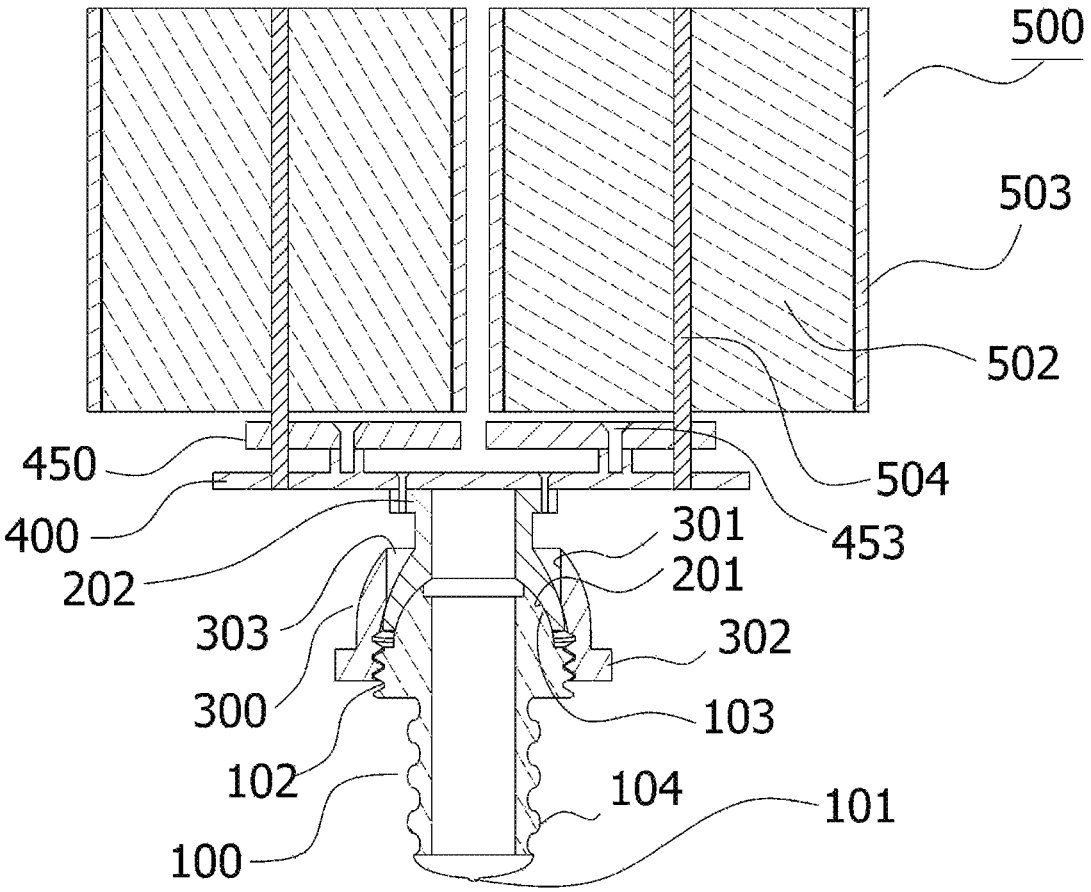
FIG. 8 is a longitudinal sectional view illustrating a structure of the fixture according to the present disclosure.

To this end, as illustrated in the exploded perspective view of FIG. 6, the perspective view of FIG. 7, and the longitudinal sectional view of FIG. 8, the present disclosure includes a base 100 which is coupled to the Edison socket 601 and includes a threaded portion 104 formed around the base 100 and a terminal 101 provided at a lower end of the base 100; a screw portion 102 formed above the base 100; a sphere body 103 formed above the screw portion 102; an engagement member 200 configured with a concave inlet portion 201 in close contact with the sphere body 103 above the screw portion 102 and a connection plate 202 installed in the concave inlet portion 201; a cover 300 in which a pressing portion 301 covering the outside of the concave inlet portion 201 of the engagement member 200, a through-hole 303 passing through the connection plate 202, and a tightening nut 302 fastened to the screw portion 102 of the base 100 are integrally formed; a plate 400 including a center hole 403 which is fixed to the connection plate 202 of the engagement member 200 and fixes the center of the plate-shaped LED 500, and first position fixing means 401 for fixing an angle of the plate-shaped LED 500; a rotation plate 450 in which an axis hole 454 is formed on the same axis as the center hole 403 of the plate 400 and includes second position fixing means fastened to the first position fixing means 401; and the plate-shaped LED 500 which is fixed to the rotation plate 450 and whose rotation axis is installed coaxially with the center hole 403 of the plate 400 to integrally rotate with a rotation plate 450 around the rotation axis.

The plat 400 may have a plurality of the plate-shape LEDs 500 and a plurality of the rotation plates 450.

In the present disclosure configured as described above, an angle between the plate 400 to which the plate-shaped LED 500 is fixed and the base 100 is determined by the engagement member 200 and the sphere body 103 of the base 200.

That is, in the present disclosure, by rotating the base 100 as illustrated in FIG. 5 in a state where the tightening nut 302 of the cover 300 is separated from the screw portion 102 of the base 100, the threaded portion 104 and the terminal 101 of the base 100 are coupled with the Edison socket 601 provided in the casing 600 of the lamp fixture. An angle of the concave inlet portion 201 of the engagement member 200 in close contact with the sphere body 103 of the base 100 is adjusted as necessary, and thereafter, the tightening nut 302 is tightened to the screw portion 102 in a state where the pressing portion 301 of the cover 300 maintains a contact state between the current concave inlet portion 201 and the sphere body 103, and as a result, an angle of the plate 400 fixed by the connection plate 202, a fastening screw, and the like of the bleed 200 is fixed.

By doing so, in the present disclosure, the base 100 may be coupled to the Edison socket 601 at any angle without rotating the plate-shaped LED (500).

In addition to this, in the present disclosure, the plate-shaped LED 500 may be divided into two or more to be disposed, angles thereof may be adjusted independently, and thereby, a light emission range may be appropriately adjusted according to the installation location. In the drawings, two plate-shaped LEDs 500 are illustrated as an embodiment, but the present disclosure is not limited thereto and multiple plate-shaped LEDS may be provided in the same method. A case where the plate-shaped LED 500 is divided into two will be described for the sake of clear description. The two plate-shaped LEDs 500 are separated by using a center axis bar 504 as a center depending on the installation location, angles thereof are adjusted respectively, and thereafter, the two plate-shaped LEDs 500 may be fixed to the plate 400 by using the second position fixing means and the first position fixing means 401 of the rotation plate 450.

To this end, as illustrated in FIGS. 6 to 8, a rotation axis of the plate-shaped LED 500 is inserted into the center hole 403 of the plate 400 together with the rotation plate 450 such that the plate-shaped LED 500 is rotatable, the first position fixing means 401 may be configured to have an arc-shaped fastening hole 402, the second position fixing means may configure a through-hole 452 passing through the rotation plate 450 and a fixing screw 453 fixed to the fastening hole 402 of the first position fixing means 401 through the through-hole 452, the fixing screw 453 is fixed to any one position of the arc-shaped fastening hole 402 of the first position fixing means 401 through the through-hole 452 after adjusting the rotation angle by rotating the plate-shaped LED (500) with the rotation plate 450 around the rotation axis, and thereby, the rotation plate 450 may be fixed to the plate 400 at the rotated angle by the arc-shaped fixing screw 453.

Further, the first position fixing means 401 may have a plurality of protrusions repeatedly formed inside the arc-shaped fastening hole 402, the second position fixing means may be configured by a rotation plate 450 fixed to a bottom of the plate-shaped LED 500 and an elastic body protruding from the rotation plate 450 and slid between the protrusions inside the fastening hole 402, and, when the elastic body of the rotation plate 450 inserted between the protrusions inside the fastening hole 402 rotates the rotation plate 450 or the plate-shaped LED 500 fixed to the rotation plate 450, the elastic body is partially deformed and moved between the next protrusions inside the fastening hole 402, and then, recovered, and thereby, a rotation angle of the plate-shaped LED 500 may be fixed. Alternatively, if the elastic body of the rotation plate 450 is pushed by a rotation force of the rotation plate 450 or the plate-shaped LED 500 fixed to the rotation plate 450 and thereby a protruding length is reduced and the rotation force disappears, the protruding length is recovered by the elastic force, and thus, the rotation angle of the plate-shaped LED (500) may be fixed.

Figure 9:
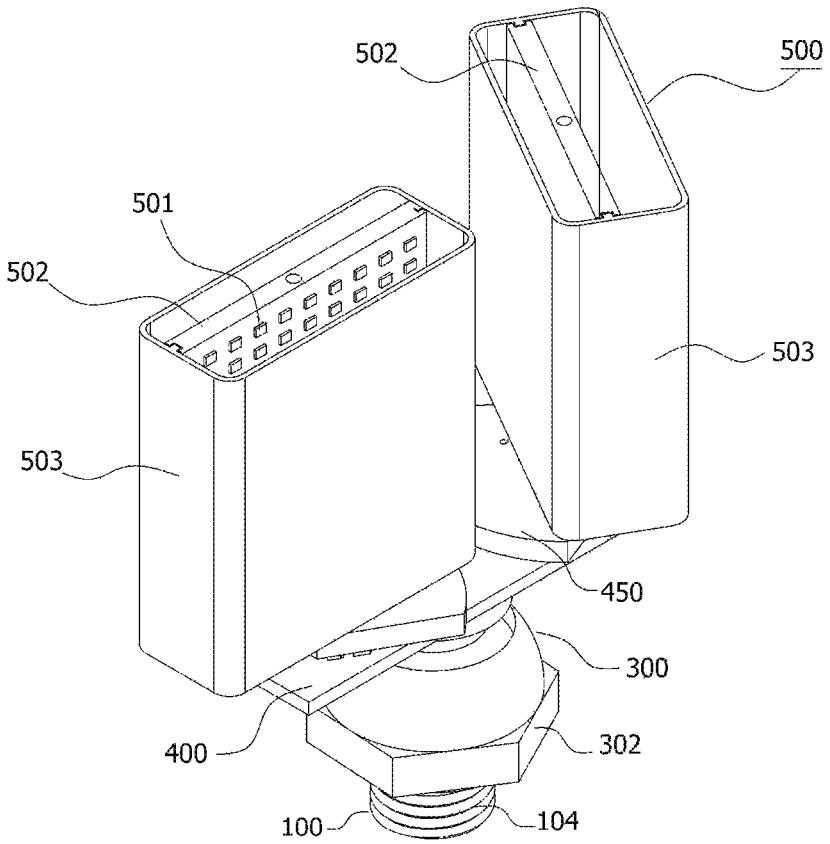
FIG. 9 is an explanatory diagram illustrating an angle adjustment state of the plate-shaped LED of the fixture according to the present disclosure.

Accordingly, in the present disclosure, the two plate-shaped LEDs 500 may be installed so as to have different angles from each other, and thus, the two plate-shaped LEDs 500 may be constructed in an optimized state depending on an installation location. This state is illustrated in FIG. 9.

Further, if crops are grown on the back of a street lamp, the crops are damaged by light pollution such as the street light being illuminated at night, which causes the crops to overgrow. In order to prevent the crops from overgrowing, the present disclosure may adjust an emission direction of light.

Figure 10:
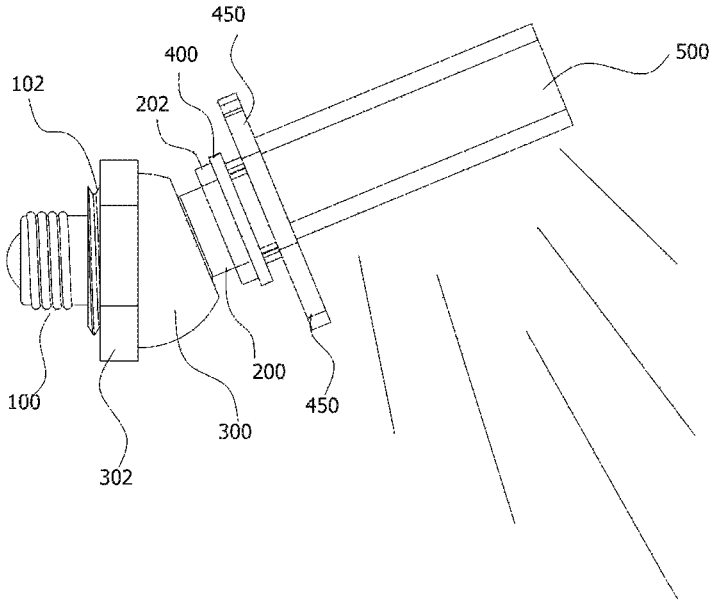
FIG. 10 is a side view illustrating a tilting fixing state of the fixture according to the present disclosure.

To this end, in the present disclosure, an irradiation angle is raised in the direction of a road such that light is not emitted towards the back. To this end, as illustrated in FIG. 10, an angle between the base 100 and the engagement member 200 is adjusted to couple the tightening nut 302 of the cover 300 with the screw portion 102 by rotating the tightening nut 302, and thereby, light of the plate-shaped LED 500 is emitted in the direction of a comb teeth in the lower right of FIG. 10. Accordingly, the light is prevented from emitting to the back of the street lamp, and thus, growth of the crops is not disturbed.

Further, in the present disclosure, since a rotation angle of the plate-shaped LED 500 itself is adjustable, a metal halide lamp using the Edison socket 601 of the thin street lamp may be replaced with an LED lamp, and a light emission direction may be adjusted up, down, left, right by adjusting an intimate angle between the sphere body 103 of the base 100 and the concave inlet portion 201 of the engagement member 200, and furthermore, the emission direction of light of the two plate-shaped LEDs 500 may be adjusted and fixed independently. Accordingly, a security lamp and a street lamp may be constructed in a state optimal for an actual situation.

Figure 11:
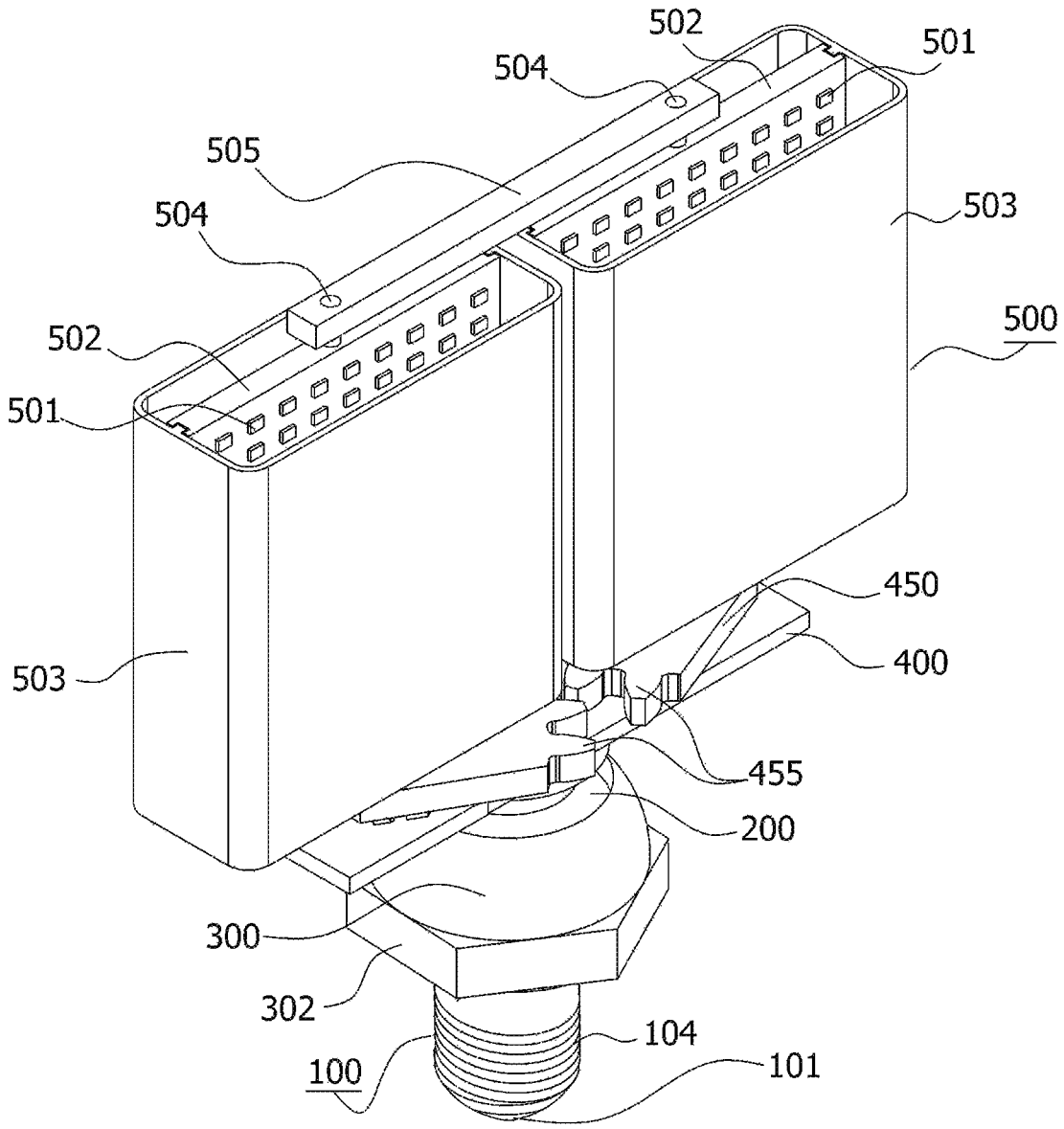
FIG. 11 is a perspective view illustrating a plate-shaped LED lamp fixture for the Edison socket according to another embodiment.
Figure 12:
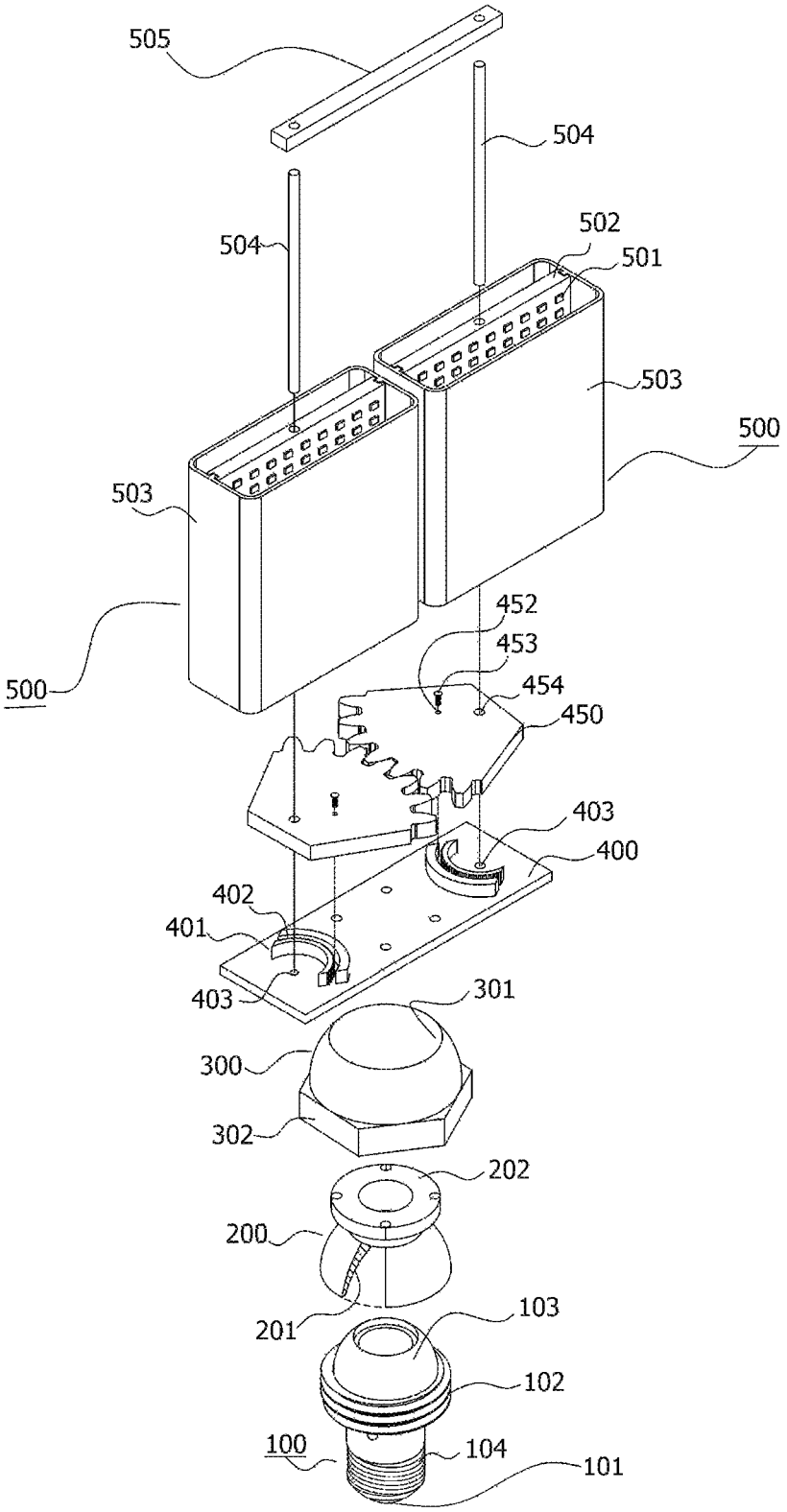
FIG. 12 is an exploded perspective view of the present disclosure according to the embodiment illustrated in FIG. 11.
Figure 13:
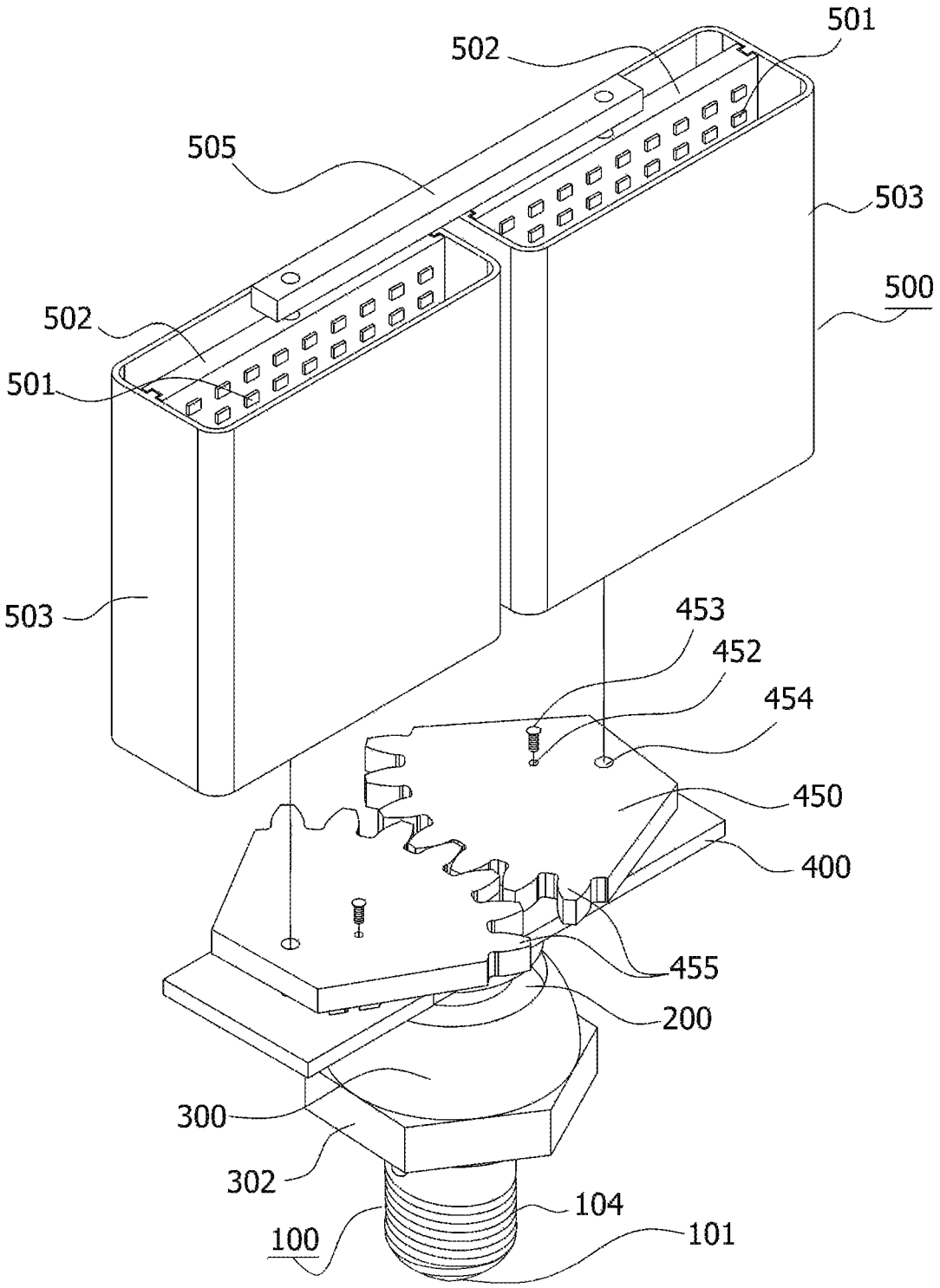
FIG. 13 is a perspective view illustrating an irradiation angle setting structure of the present disclosure according to the embodiment illustrated in FIG. 11.
Figure 14:
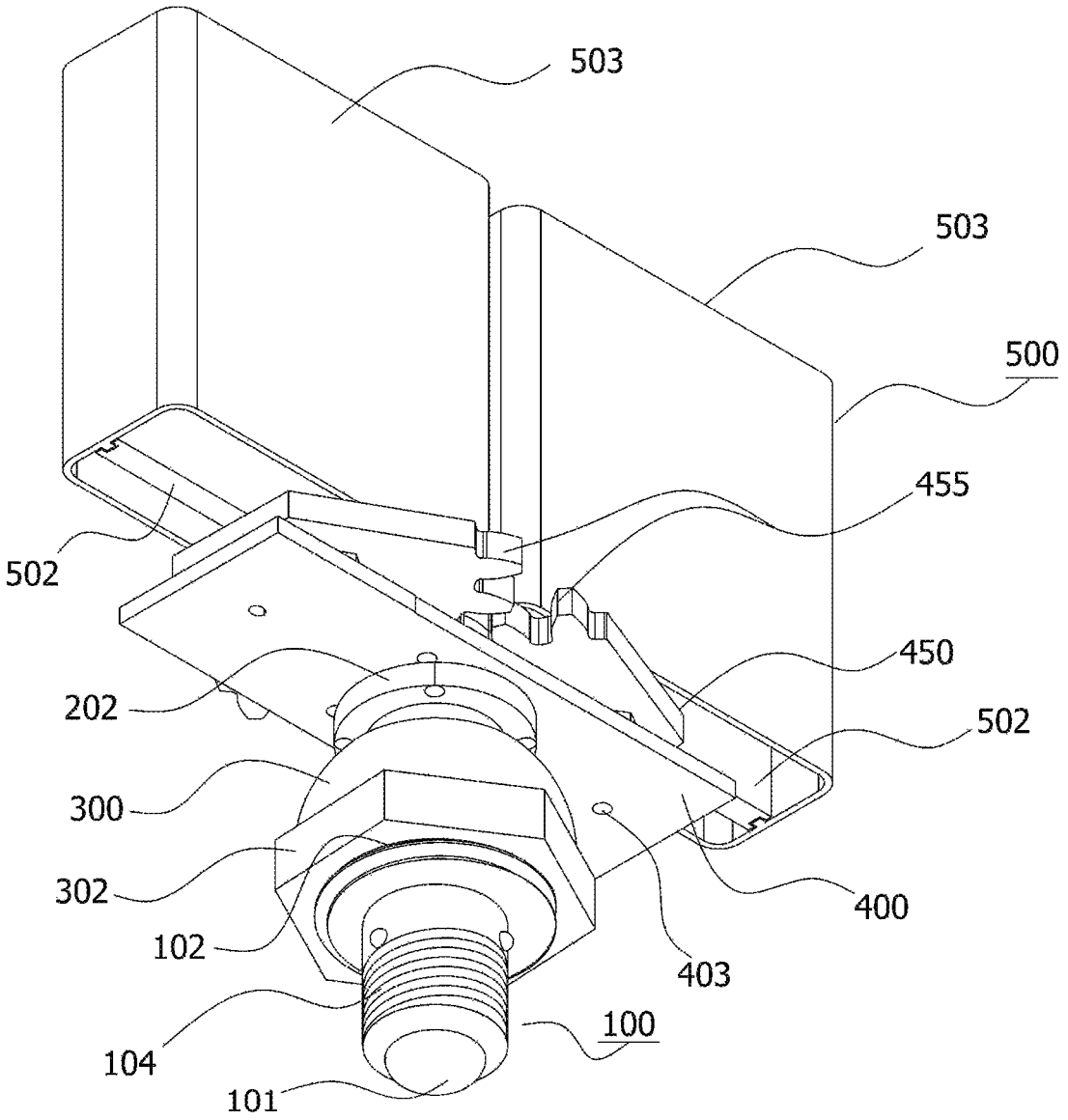
FIG. 14 is a perspective view from below of the present disclosure according to the embodiment illustrated in FIG. 11.
Figure 15:
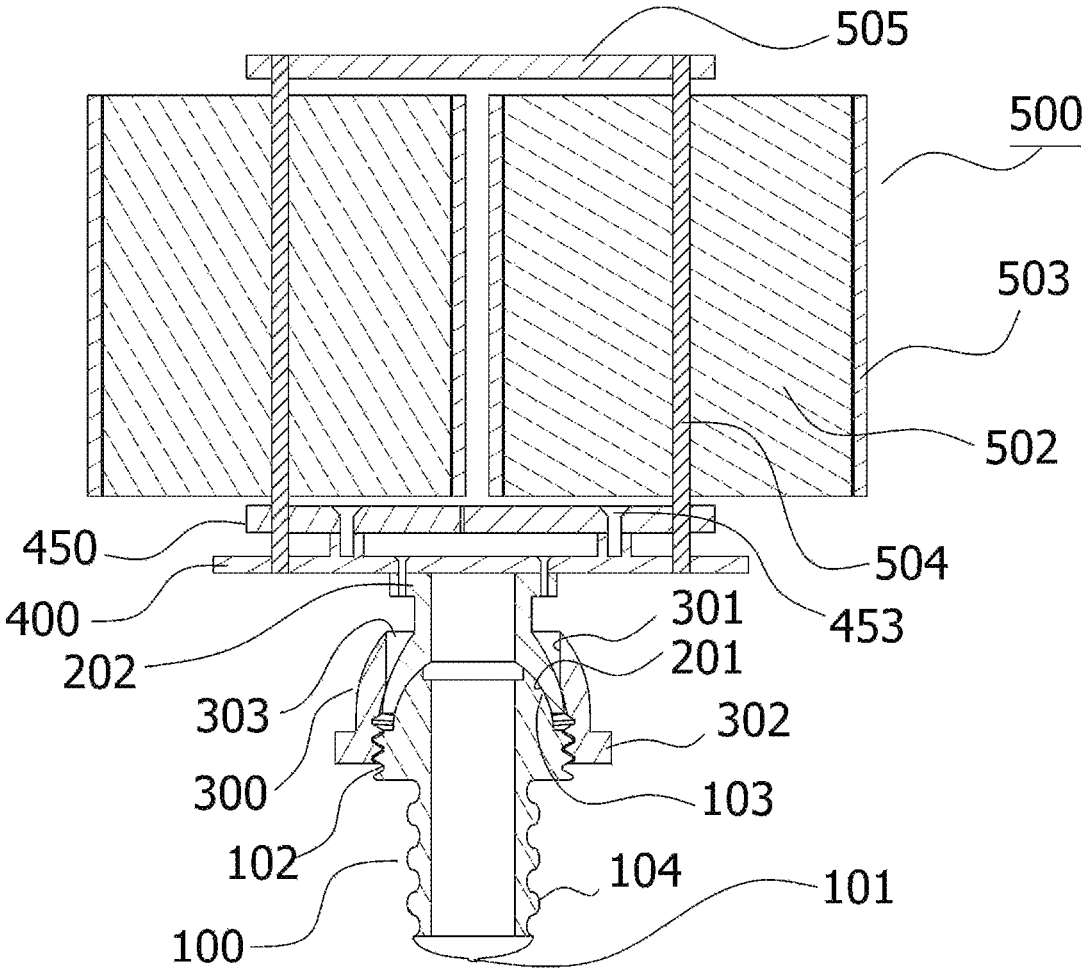
FIG. 15 is a longitudinal sectional view illustrating the fixture of the present disclosure according to the embodiment illustrated in FIG. 11.

In addition, in the present disclosure, as illustrated in FIG. 11, the plate-shaped LEDs 500 may perform a peristaltic operation at the same angle by allowing the rotation plate 450 fixed to the center hole 403 of the plate 400 to rotate to perform the peristaltic operation. To this end, the present disclosure, as illustrated in FIGS. 11 to 15, includes the threaded portion 104 and the terminal 101 on the periphery and the lower end of the base 100 coupled to the Edison socket 601; the cover 300 which covers the outside of the concave inlet portion 200 of the engagement member 200 and in which the screw portion 102 formed at an upper end of the base 100, the sphere body 103 formed above the screw portion 102, the concave inlet portion 201 in close contact with the sphere body 103 above the screw portion 102, and the fastening nut 302 fastened to the screw portion 102 of the base 100 are integrally formed; the plate 400 which is fixed to the connection plate 202 above the engagement member 200 and includes two center holes 403 and two first position fixing means 401 for fixing the plate-shaped LEDs 500; the two rotation plates 450 which is installed axially in the two center holes 403 of the plate 400 respectively and have two second position fixing means; and the two plate-shaped LEDs 500 which are installed above the two rotation plates 450 and are installed coaxially with the central holes 403 and the rotation plates 450 of the plate 400 by the rotation axis. Engagement gears 455 are provided around each of the two rotation plates 450 to interlock to rotate, and upper ends of the center axis bars 504 of the two plate-shaped LEDs 500 fixed by the center axis bars 504 on the rotation plates 450 are connected by a linkage 505.

In the embodiment according to the present disclosure as described above, the base 100 described with reference to FIG. 5 is coupled to the Edison socket 601, and an angle at which the sphere body 103 of the base 100 and the concave inlet portion 201 of the engagement inlet portion 200 are in close contact with each other is adjusted as illustrated in FIG. 10, and thereafter, the tightening nut 302 of the cover 300 is coupled to the screw portion 102 of the base 100, and thereby, an installation angle is fixed.

If the plate-shaped LED 500 rotates after doing so, the rotation plate 450 rotates together with the LED, and thereby, the other rotation plate 450 is rotated by the engagement gears 455 of the rotation plate 450, and the plate-shaped LEDs 500 fixed on the other rotation plates 450 perform a peristaltic operation. That is, the plate-shaped LEDs 500 rotate in opposite directions and move at symmetrical angles.

In the present disclosure, since the rotation plates 450 below the plate-shaped LEDs 500 are peristaltically moved by the engagement gears 455 and upper portions of the plate-shaped LEDs 500 move together with the linkage 505 at the same time, even if sizes of the plate-shaped LEDs 500 are large, the plate-shaped LEDs 500 are symmetrical in a stable state and a smooth angle adjustment thereof is possible.

After the angle is optimized by doing so, the through-hole 452 and the fixing screw 453 are provided as the second position fixing means, and the fixing screw 453 is fixed to any one position of the arc-shaped fastening hole 402 of the first position fixing means 401 through the through-hole 452, and thereby, the rotation plate 450 may be fixed to the plate 400 by the fixing screw 453 at a fixed angle.

According to the embodiments illustrated in FIGS. 11 to 15, in the same manner as the embodiments illustrated in FIGS. 5 to 10, a metal halide lamp using the Edison socket 601 may be replaced with an LED lamp, and an light emission direction may be adjusted up, down, left, right by adjusting an intimate angle between the sphere body 103 of the base 100 and the concave inlet portion 201 of the engagement member 200, and furthermore, the light emission direction of the two plate-shaped LEDs 500 may be adjusted and fixed by the engagement gears 455 of the rotation plate 450 at one operation and fixed independently. Accordingly, a security lamp and a street lamp may be easily constructed in a state optimal for an actual situation.

In addition, in the present disclosure, since the plate-shaped LED 500 emits light having a very strong straightness, it is necessary to use a diffusion plate 503 so as to prevent glare by diffusing the light, and when a diffusion configuration is installed in the casing 600 as needed, the diffusion plate 503 formed in the plate-shaped LED 500 may not be used.

Figure 16A:
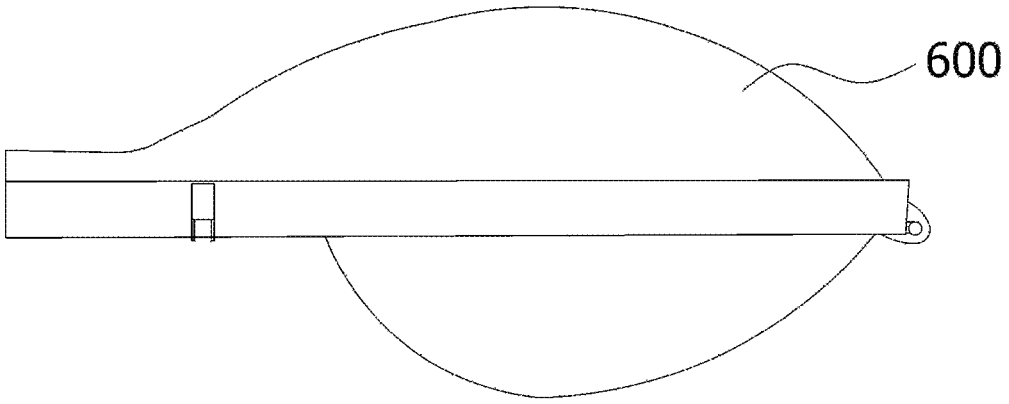
FIGS. 16A to 17B are exemplary views of a street lamp fixture to which the plate-shaped LED lamp according to the present disclosure can be applied.
Figure 16B:
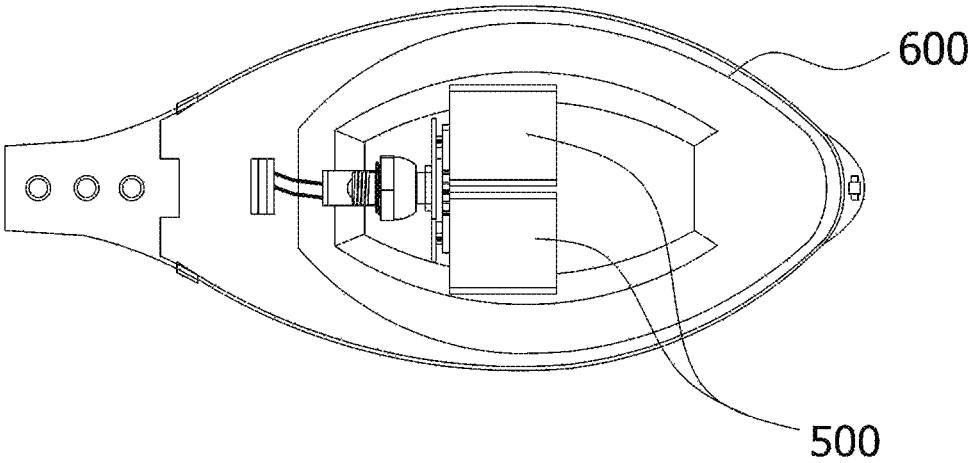
Figure 17A:
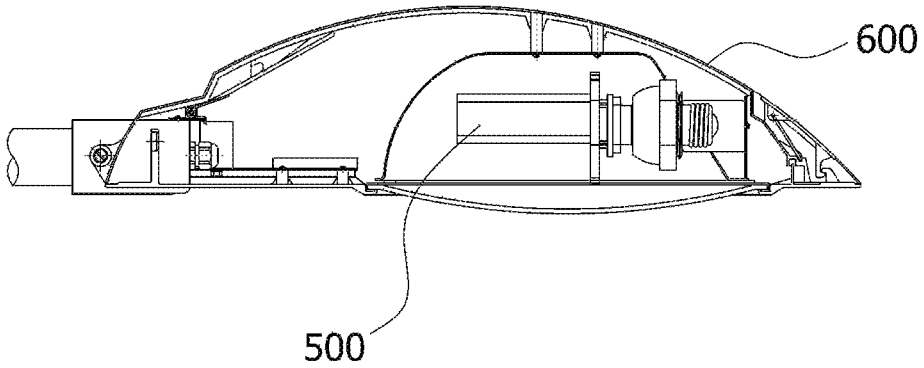
Figure 17B:
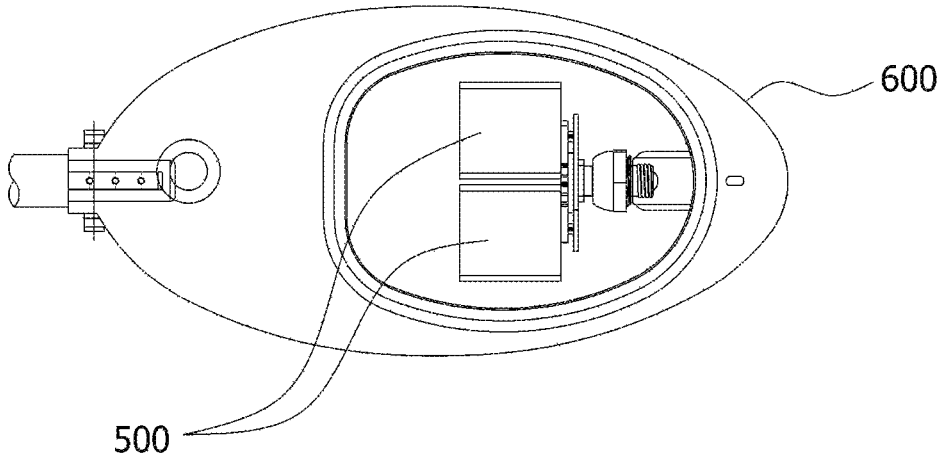

In addition, the present disclosure may be applied to a street lamp or a security lamp to which the Edison socket is applied as illustrated in FIGS. 16 and 17 and may be utilized for a tunnel lamp illustrated in FIG. 18 or a flood lamp illustrated in FIG. 19.

Figure 18A:
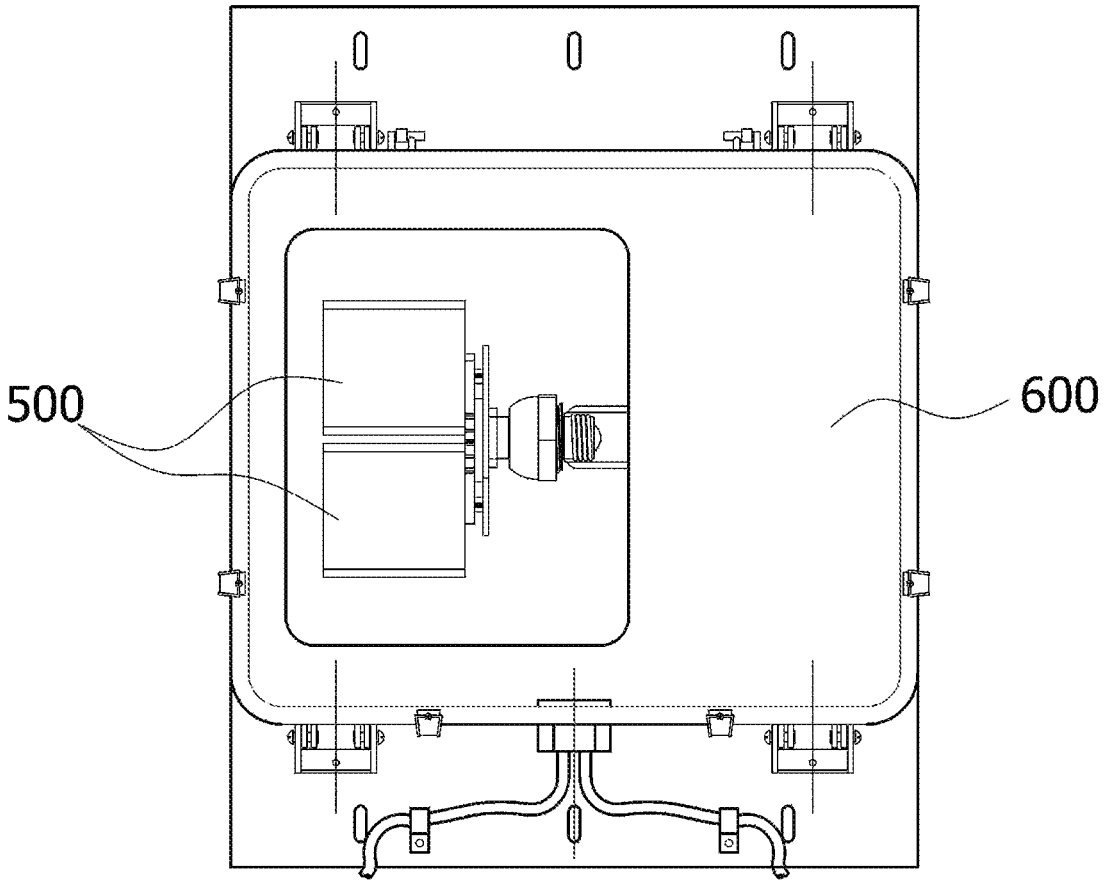
FIGS. 18A and 18B are exemplary views of a tunnel lamp fixture to which the plate-shaped LED lamp according to the present disclosure can be applied.
Figure 18B:
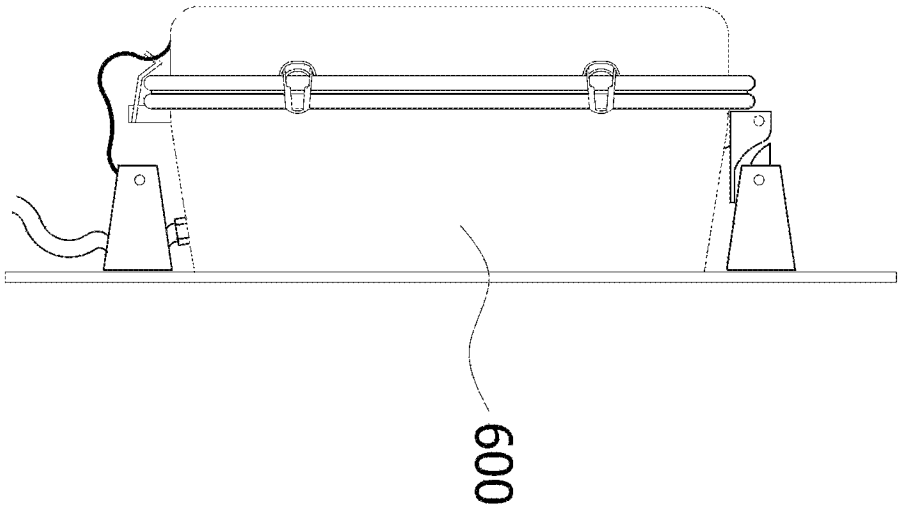
Figure 19A:
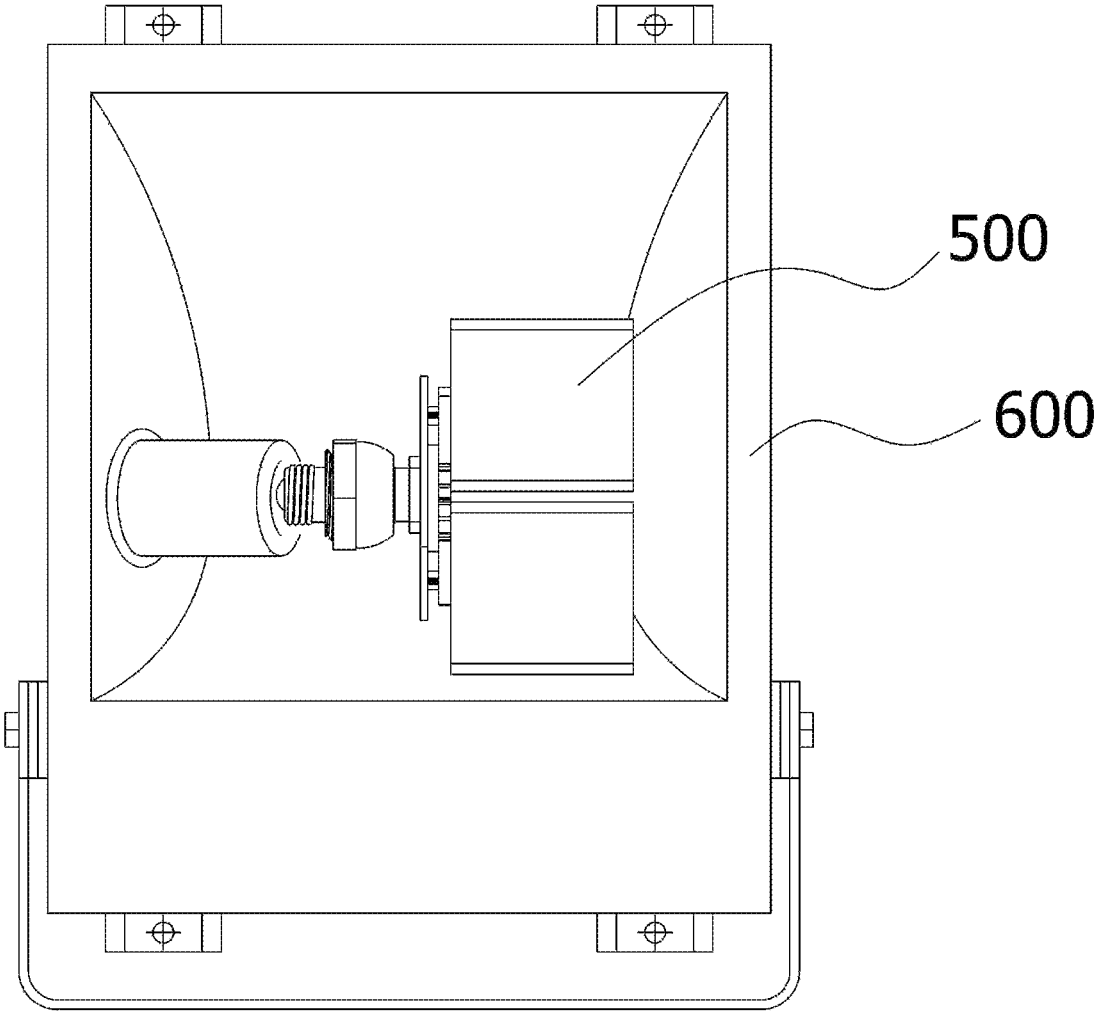
FIGS. 19A and 19B are exemplary views of a flood lamp fixture to which the plate-shaped LED lamp according to the present disclosure can be applied.
Figure 19B:
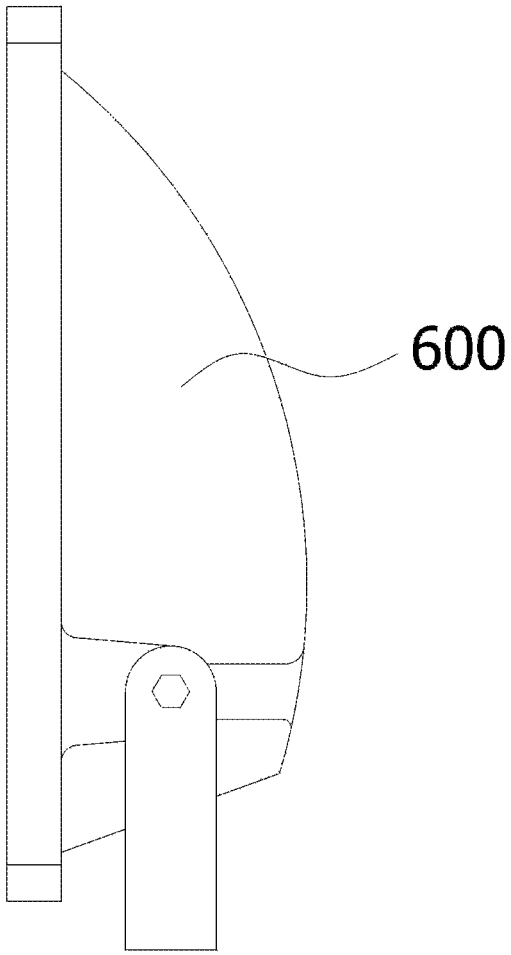

That is, FIGS. 16A, 16B, 17A, and 17B are examples a side sectional view and a bottom view of a street lamp having the Edison socket, FIGS. 18A and 18B are examples of a front view and a side view of a tunnel lamp including the Edison socket, and FIGS. 19A and 19B are examples of a front view and a side view of a flood lamp including the Edison socket. As described above, a lamp configured with the plate-shaped LED 500 according to the present disclosure may be applied to various types of fixtures illustrated in FIGS. 16A to 19B, and may also be applied to all lamp fixtures using the Edison sockets configured by various forms required by other users.

As such, the technical idea of the present disclosure is described with reference to the accompanying drawings, the present disclosure is described by way of the best example, the embodiment is not intended to limit the present disclosure, those skilled in the art may make various changes and imitations of a dimension, a shape, a structure, and the like without departing from the scope of the technical idea of the present disclosure, and the changes and imitations are included in the scope of the technical idea of the present disclosure.

What is claimed is:

1. A plate-shaped LED lamp fixture with an irradiation angle setting function for an Edison socket, the plate-shaped LED lamp fixture comprising:

a base coupled to the Edison socket;

a screw portion formed at an upper end of the base;

a sphere body formed above the screw portion;

a concave inlet portion coming in close contact with the sphere body;

an engagement member configured with a connection plate fixed to the concave inlet portion;

a pressing portion covering an outside of the concave inlet portion of the engagement member;

a cover formed with a through-hole passing through the connection plate and a tightening nut fastened to the screw portion of the base;

a plate fixed to the connection plate of the engagement member and including a center hole connected to a rotation axis of the plate-shaped LED and a first position fixing means fixing an angle of the plate-shaped LED; and a rotation plate in which an axis hole is formed on the same axis as a center hole of the plate and a second position fixing means fastened to the first position fixing means is provided, wherein the plate-shaped LED is fixed to the rotation plate and the rotation axis thereof is installed coaxially with the center hole of the plate to integrally rotate with a rotation plate around the rotation axis, wherein a plurality of the plate-shaped LEDs and a plurality of the rotation plates are provided in the plate, wherein the first position fixing means of the plate includes an arc-shaped fastening hole formed around the center hole, and wherein the second position fixing means includes a fixing screw coupled to any one location of the arc-shaped fastening hole through the rotation plate, wherein the rotation plates fixed to a bottom of the plate-shaped LEDs include engagement gears interlocked with each other.

2. The plate-shaped LED lamp fixture according to claim 1, wherein the first position fixing means of the plate includes a plurality of protrusions repeatedly formed inside an arc-shaped fastening hole formed around the center hole, and wherein the second position fixing means is configured by rotation plates respectively fixed to bottoms of the plate-shaped LEDs and elastic bodies protruding from the rotation plates and slide between the protrusions of the fastening holes to allow the plate-shaped LEDs to be fixed at different angles.

* * * * *